US008800713B2

(12) United States Patent
Keesser et al.

(10) Patent No.: US 8,800,713 B2
(45) Date of Patent: Aug. 12, 2014

(54) PLASTIC MUFFLER WITH HELMHOLTZ CHAMBER

(75) Inventors: Thorsten Keesser, Augsburg (DE); Robin Willats, Columbus, IN (US); Dennis Boennen, Bobingen (DE); Joseph E. Callahan, Greenwood, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days.

(21) Appl. No.: 13/576,820

(22) PCT Filed: Jan. 12, 2011

(86) PCT No.: PCT/US2011/020917

§ 371 (c)(1),
(2), (4) Date: Aug. 2, 2012

(87) PCT Pub. No.: WO2011/100083

PCT Pub. Date: Aug. 18, 2011

(65) Prior Publication Data

US 2012/0292128 A1 Nov. 22, 2012

Related U.S. Application Data

(60) Provisional application No. 61/303,408, filed on Feb. 11, 2010.

(51) Int. Cl.
*F01N 1/02* (2006.01)
*F01N 1/04* (2006.01)

(52) U.S. Cl.
USPC ..... 181/250; 181/246; 181/252; 181/255; 181/266; 181/273

(58) Field of Classification Search
USPC ..... 181/244, 246, 249, 250, 252, 253, 255, 181/256, 264, 266, 269, 272, 273, 282
See application file for complete search history.

(56) References Cited

U.S. PATENT DOCUMENTS

| | | | | |
|---|---|---|---|---|
| 2,311,676 | A * | 2/1943 | Maxim | 181/252 |
| 2,904,125 | A * | 9/1959 | Bourne et al. | 181/248 |
| 3,434,565 | A * | 3/1969 | Fischer | 181/250 |
| 3,920,095 | A | 11/1975 | Clark | |
| 4,589,517 | A * | 5/1986 | Fukuda | 181/265 |
| 4,993,513 | A * | 2/1991 | Inoue et al. | 181/282 |
| 5,340,952 | A * | 8/1994 | Takiguchi | 181/282 |
| 5,350,888 | A * | 9/1994 | Sager et al. | 181/247 |
| 5,365,025 | A * | 11/1994 | Kraai et al. | 181/249 |
| 5,783,780 | A * | 7/1998 | Watanabe et al. | 181/229 |
| 7,293,627 | B2 * | 11/2007 | Kruger et al. | 181/206 |
| 7,325,652 | B2 * | 2/2008 | Huff et al. | 181/246 |
| 2005/0252716 | A1 | 11/2005 | Moenssen et al. | |

(Continued)

FOREIGN PATENT DOCUMENTS

KR 100501449 B1 7/2005

*Primary Examiner* — Jeremy Luks
(74) *Attorney, Agent, or Firm* — Carlson, Gaskey & Olds, PC

(57) ABSTRACT

A muffler for a vehicle exhaust system includes a plastic outer shell that defines an internal cavity. A metal pipe extends through the internal cavity from an inlet to an outlet. A Helmholtz chamber is formed within the plastic outer shell to attenuate a desired frequency.

20 Claims, 9 Drawing Sheets

(56) References Cited

U.S. PATENT DOCUMENTS

2006/0037808 A1 2/2006 Kruger et al.
2008/0066999 A1* 3/2008 Kostun et al. ..... 181/250
2009/0194364 A1* 8/2009 Leboeuf et al. ..... 181/247

* cited by examiner

PLASTIC MUFFLER WITH HELMHOLTZ CHAMBER

RELATED APPLICATION

This is the U.S. national phase of PCT/US2011/020917, filed Jan. 23, 2011, which claims priority to U.S. Provisional Application No. 61/303,408, filed Feb. 11, 2010.

TECHNICAL FIELD

This invention generally relates to a plastic muffler that includes a Helmholtz chamber.

BACKGROUND OF THE INVENTION

Conventional plastic mufflers include an outer plastic shell with a metal pipe located within an internal cavity to extend from an inlet to an outlet. These conventional plastic mufflers include packing material that completely fills the internal cavity formed between the metal pipe and the outer plastic shell to provide a fully packed configuration. Packing the internal cavity reduces heat transfer from the internal metal pipe to the outer plastic shell.

While this fully packed configuration provides broadband noise attenuation, it is often desirable to attenuate a specific frequency and/or a limited range of frequencies. Incorporating structure to provide specific noise attenuation characteristics has proved challenging in plastic mufflers.

SUMMARY OF THE INVENTION

A muffler for a vehicle exhaust system includes a plastic outer shell defining an internal cavity with an inlet and an outlet. An inner metal pipe extends from the inlet to the outlet. A Helmholtz chamber is located within the plastic outer shell for noise attenuation purposes.

In one example, the muffler includes a Helmholtz neck that is associated with one of the inner metal pipe or the plastic outer shell.

In on example, the muffler is not fully packed such that at least a portion of the internal cavity is free from packing material.

In one example, the muffler includes a shielding cartridge. The shielding cartridge comprises at least a metal outer pipe that surrounds a portion of an axial length of the metal inner pipe within the internal cavity, and includes packing material positioned within a gap formed between the inner and outer metal pipes.

In one example, a thermally insulating end plate is mounted between the metal inner pipe and the plastic outer shell at each of the inlet and outlet to thermally decouple the metal inner pipe from the plastic outer shell.

In one example, a baffle is used to separate the internal cavity into first and second chambers. One of the first and second chambers forms the Helmholtz chamber and the other of the first and second chambers forms an expansion chamber.

These and other features of the present invention can be best understood from the following specification and drawings, the following of which is a brief description.

DETAILED DESCRIPTION

Figure 1:
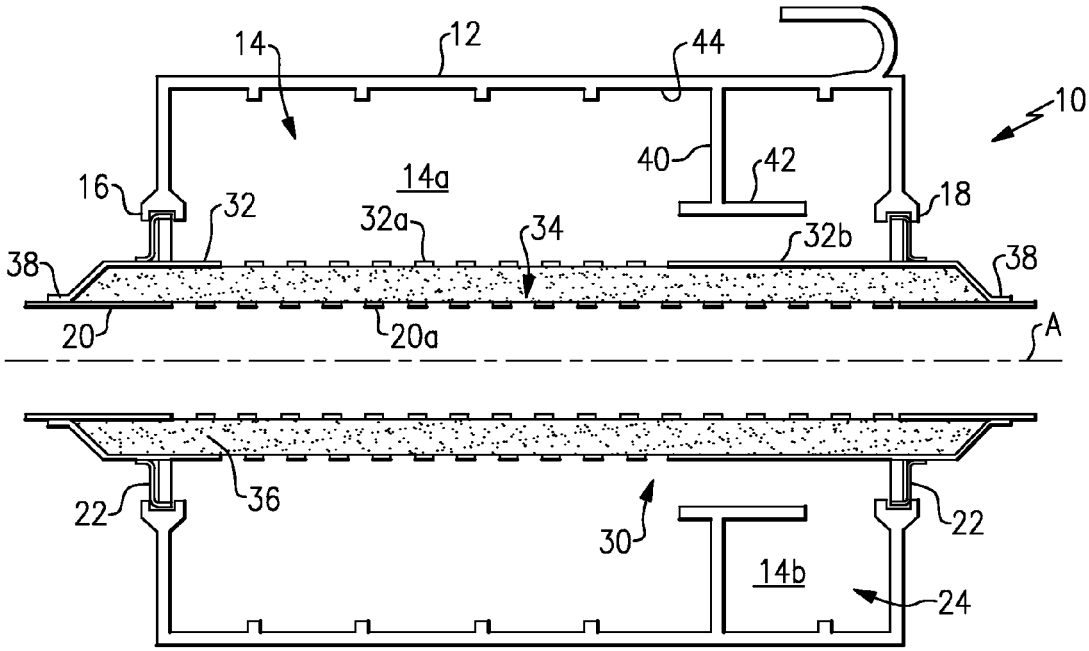
FIG. 1 is a schematic view of one example of a plastic muffler with a Helmholtz chamber.

A muffler for a vehicle exhaust system is shown generally at 10 in FIG. 1. The muffler 10 includes a plastic outer shell 12 that defines an internal cavity 14, and which extends from an inlet 16 to an outlet 18. A metal inner pipe 20 is positioned within the internal cavity 14 and extends along a central axis A from the inlet 16 to the outlet 18. The metal inner pipe 20 directs heated exhaust gases through the muffler 10 from an upstream engine to a downstream exhaust component. Thermally insulating end plates 22 extend between the metal inner pipe 20 and the plastic outer shell 12 at each of the inlet 16 and outlet 18, see FIGS. 3, 5, and 7-11 for example. The plates 22 serve to thermally decouple the metal inner pipe 20 from the plastic outer shell 12. FIG. 1 shows a configuration that includes a shielding cartridge 30 between the plates 22 and the inner pipe 20, this configuration will be discussed in greater detail below.

The muffler 10 includes a Helmholtz resonator defining a Helmholtz chamber 24 that is used to attenuate a desired frequency and/or limited range of frequencies during operating of the vehicle exhaust system. The Helmholtz chamber 24 can be provided in various manners within the plastic outer shell 12. In general, Helmholtz resonators include a chamber defining a main volume that is in fluid communication with a reduced volume portion or neck. The volume within the neck comprises an acoustic mass that rests on an acoustic spring formed by the main volume. Together they provide an oscillating system that can be used to absorb a desired frequency. FIGS. 1-15 show different examples of how the Helmholtz chamber 24 is incorporated within the plastic outer shell 12.

FIG. 1 shows a configuration that includes a shielding cartridge 30 that is positioned radially between the plastic outer shell 12 and the metal inner pipe 20. The shielding cartridge 30 includes an outer metal pipe 32 that is spaced radially from the metal inner pipe 20 by a gap 34. Packing material 36 fills the gap 34. In the example of FIG. 1, the metal outer pipe 32 extends along the entire length of the metal inner pipe 20 within the internal cavity 14 and has ends 38 that are connected to the metal inner pipe 20 outside of the muffler 10. In this type of configuration, the thermally insulating end plates 22 extend from the metal outer pipe 32 to the plastic outer shell 12.

A baffle 40 is positioned within the internal cavity 14 and supports a Helmholtz neck 42 that extends in a direction that is common with the central axis A. The neck 42 comprises a ring-shaped member that is spaced radially outwardly of the metal outer pipe 32. The baffle 40 extends in a direction transverse to the central axis A from an outer surface of the neck 42 to an inner surface 44 of the plastic shell 12. The baffle 40 and neck 42 cooperate to form first 14*a* and second 14*b* chambers within the internal cavity 14. In the example shown, the first chamber 14*a* comprises an expansion chamber and the second chamber 14*b* comprises the Helmholtz chamber 24.

The metal inner pipe 20 includes a perforated portion 20*a* that extends through both the first 14*a* and second 14*b* chambers from the inlet 16 to the outlet 18. The metal outer pipe 32 includes a perforated portion 32*a* that is located within the first chamber 14*a* and a non-perforated portion 32*b* that is positioned to extend from a beginning of the neck 42, through the second chamber 14*b*, and to the outlet 18.

Figure 2:
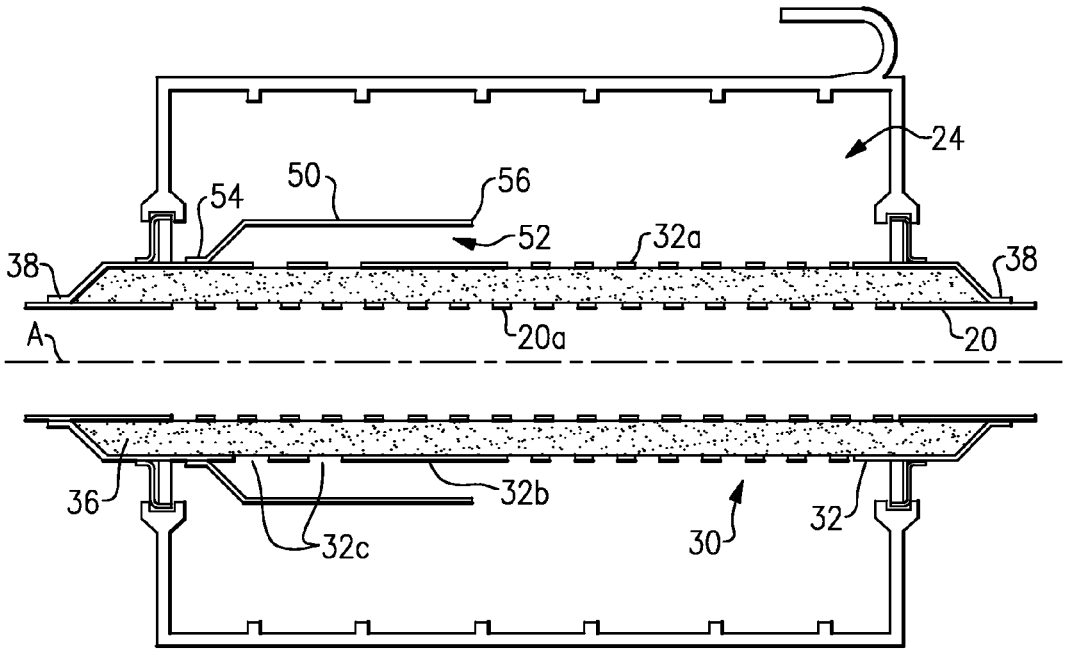
FIG. 2 is a schematic view of another example of a plastic muffler with a Helmholtz chamber.

The configuration of FIG. 2 is similar to that of FIG. 1 in that the muffler 10 includes a shielding cartridge 30, but this configuration does not include a baffle with a neck. Instead, the muffler 10 includes an overlap tube 50 that is spaced radially outwardly from the metal outer pipe 32 by an air gap 52. One end 54 of the overlap tube is fixed to the metal outer pipe 32 and the opposite end 56 is spaced from the metal outer tube 32 by the gap 52. The overlap tube 50 only extends along a portion of the overall length of the metal outer tube 32 and forms a Helmholtz neck. The length of the overlap tube 50 can be varied as needed to attenuate a desired frequency. As such, in this configuration, the entire internal cavity comprises the Helmholtz chamber 24.

In the example of FIG. 2, the shielding cartridge 30 extends along the entire length of the metal inner pipe 20 within the internal cavity 14 with the ends 38 being connected to the metal inner pipe 20 outside of the muffler 10. The metal inner pipe 20 includes a perforated portion 20*a* that extends from the inlet 16 to the outlet 18. The metal outer pipe 32 includes a perforated portion 32*a* that is spaced axially from the overlap tube 50, i.e. that overlap tube 50 does not overlap the perforated portion 32*a*. The metal outer pipe includes a non-perforated portion 32*b* positioned radially inward of the overlap pipe 50. The non-perforated portion 32*b* includes one or more discrete openings 32*c* to provide an acoustical connection to the Helmholtz chamber 24.

Figure 3:
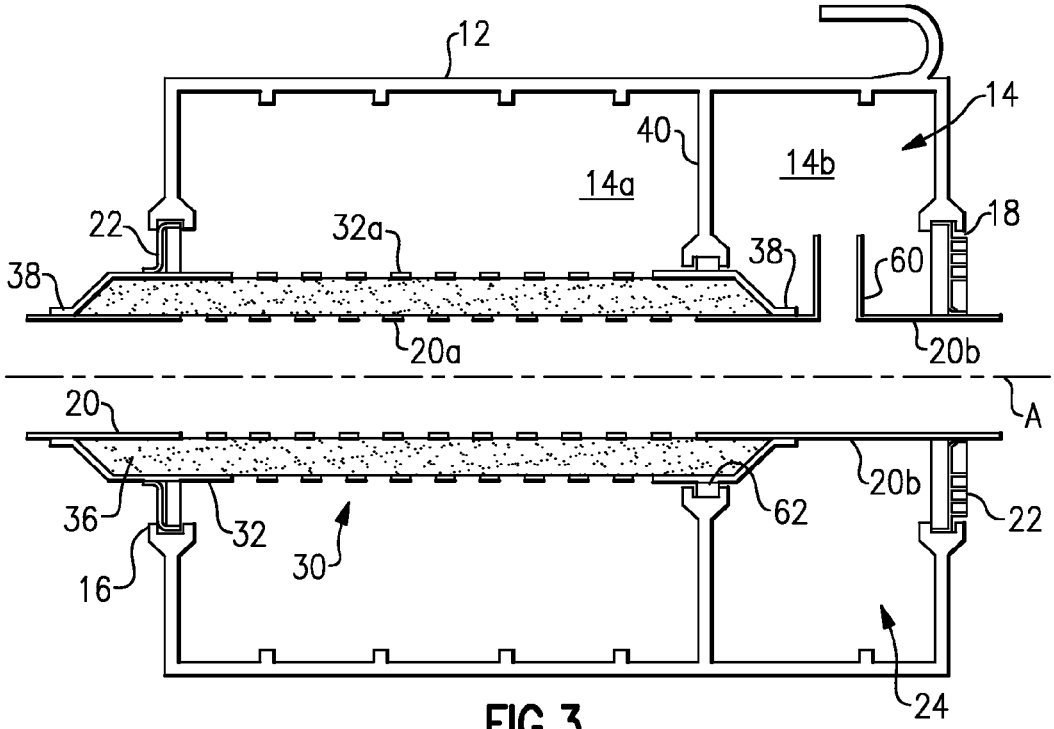
FIG. 3 is a schematic view of another example of a plastic muffler with a Helmholtz chamber.

The configuration of FIG. 3 is similar to that of FIG. 1 in that the muffler 10 includes a shielding cartridge 30 and baffle 40, but in this configuration the baffle does not include a Helmholtz neck. In this example, the shielding cartridge 30 does not extend along the entire length of the metal inner tube 20 and instead extends only from the inlet 16, through the first chamber 14*b*, and to a location just past the baffle 40. Thus, one end 38 of the cartridge 30 is connected to the metal inner pipe 20 outside of the muffler 10 and the opposite end 38 is attached to the metal inner pipe 20 within the second chamber 14*b*.

A Helmholtz neck 60 extends radially outwardly from the metal inner pipe 20 within the second chamber 14*b*. The neck 60 is axially spaced from the shielding cartridge 30. Thus, the second chamber 14*b* comprises the Helmholtz chamber 24 and the first chamber 14*a* comprises an expansion chamber. The inner metal pipe 20 includes a perforated portion 20*a* that is located within the first chamber 14*b* and a non-perforated portion 20*b* that extends from the baffle 40, through the second chamber 14*b*, and to the outlet 18. The metal outer pipe 32 includes a perforated portion 32*a* that is located within the first chamber 14*a* and includes non-perforated portions 32*b* at the inlet 16 and at the baffle 40. A gasket 62 is installed between the baffle 40 and the metal outer pipe 32 to thermally decouple the metal outer pipe 32 from the baffle 40 and associated plastic outer shell 12.

Figure 4:
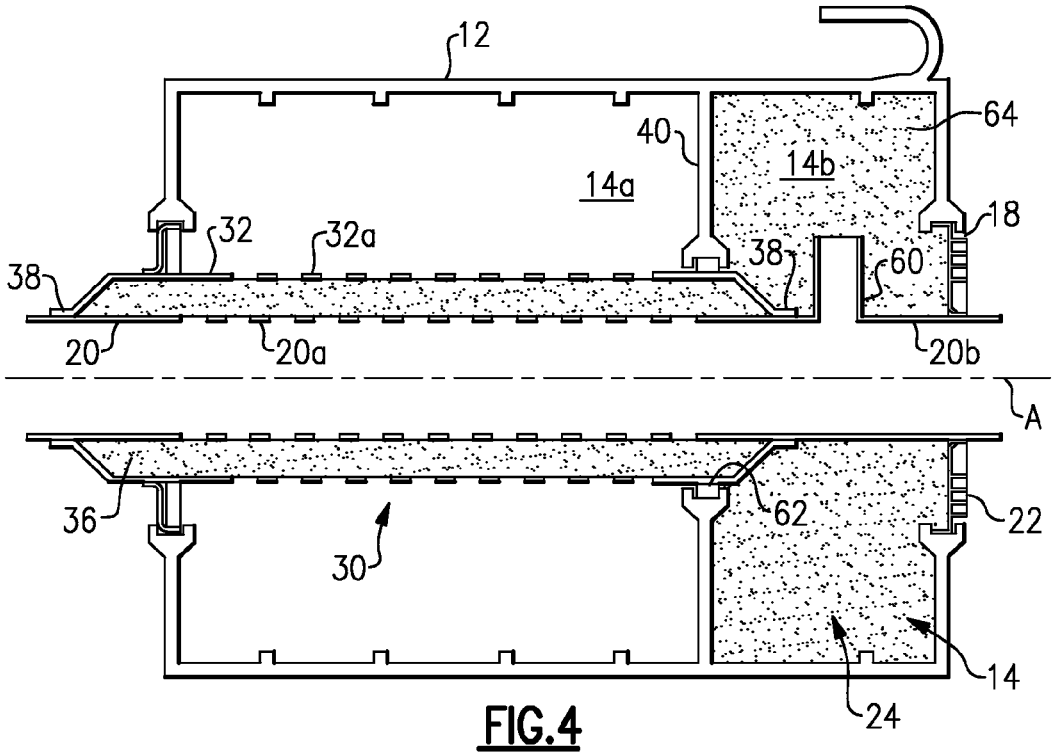
FIG. 4 is a schematic view of another example of a plastic muffler with a Helmholtz chamber.

FIG. 4 is similar to FIG. 3 but includes packing material 64 in the Helmholtz chamber 24. Filling the Helmholtz chamber 24 with packing material 64 broadens out the response and lowers the peak frequency.

Figure 5:
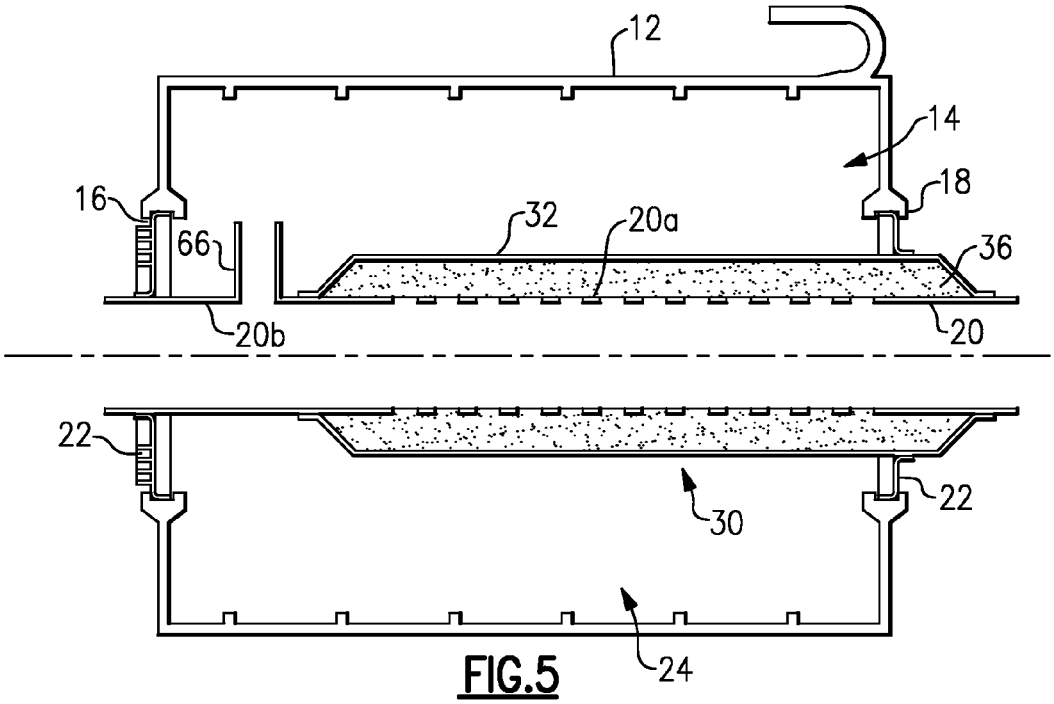
FIG. 5 is a schematic view of another example of a plastic muffler with a Helmholtz chamber.

FIG. 5 is similar to FIG. 2 but has a shorter shielding cartridge 30 and does not include an overlap tube. In the example of FIG. 5, one end 38 of the shielding cartridge 30 is secured to the inner metal pipe 20 within the internal cavity 14 and the other end 38 is secured to the metal inner pipe 20 outside of the muffler 10. This leaves a portion of the inner metal pipe 20 exposed within the internal cavity 14. This portion of the metal inner pipe 20 comprises a non-perforated portion 20*b* and includes a Helmholtz neck 66 that extends radially outwardly from the metal inner pipe 20 in a direction toward the plastic outer shell 12. The metal inner pipe 20 also includes a perforated portion 20*a* that is located within the shielding cartridge 30. The metal outer pipe 32 is non-perforated in this example.

Figure 6:
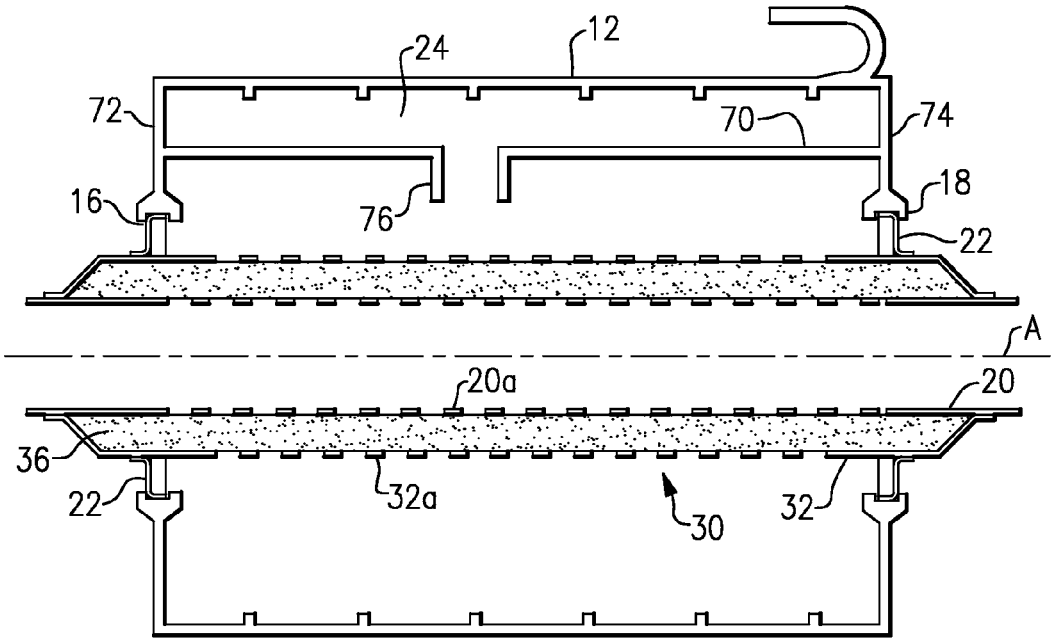
FIG. 6 is a schematic view of another example of a plastic muffler with a Helmholtz chamber.

FIG. 6 shows a configuration where the shielding cartridge 30 is similar to that of FIG. 1; however, the metal outer tube 32 includes a perforated portion 32*a* that extends substantially across the internal cavity 14 from the inlet 16 to the outlet 18. The metal inner pipe 20 also has a perforated portion 20*a* that extends from the inlet 16 to the outlet 18.

A baffle 70 positioned within the outer shell 12 extends from one end wall 72 at the inlet 16 to an opposite end wall 74 at the outlet 18. As such, the baffle 70 extends in a direction that is generally parallel to the axis A. The baffle 70 can be formed as one-piece with the plastic outer shell 12.

The baffle 70 separates the internal cavity into first 14*a* and second 14*b* chambers. A Helmholtz neck 76 extends radially outwardly from the baffle 70 toward the central axis A. The length of the neck 76 can be varied as needed to attenuate a specific frequency. The first chamber 14*a* forms an expansion chamber and the second, side chamber 14*b* forms the Helmholtz chamber 24.

Figure 7:
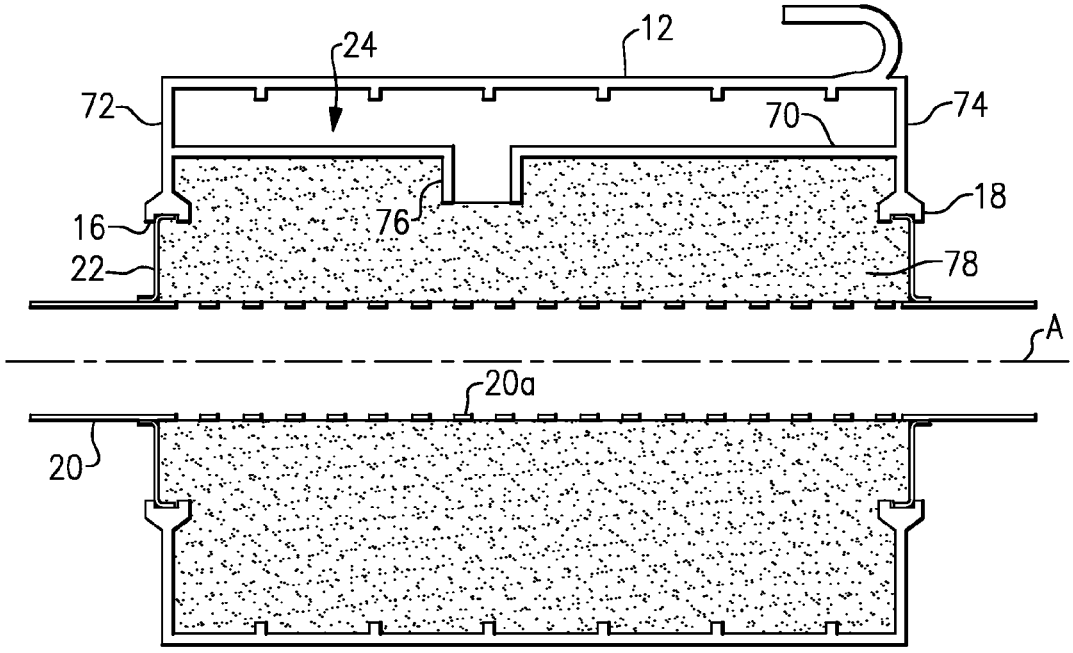
FIG. 7 is a schematic view of another example of a plastic muffler with a Helmholtz chamber.

FIG. 7 is similar to FIG. 6 but does not include a shielding cartridge 30. Instead, in this configuration, the metal inner pipe 20 is the only pipe extending between the inlet 16 and the outlet 18. The metal inner pipe 20 includes a perforated portion 20*a* that extends from the inlet 16 to the outlet 18. Packing material 78 fills the entire first chamber 14*a* (expansion chamber) and is positioned between the metal inner pipe 20 and the baffle 70 and between the metal inner pipe 20 and the outer shell 12. The second chamber 14*b* (Helmholtz chamber) remains free of packing material.

Figure 8:
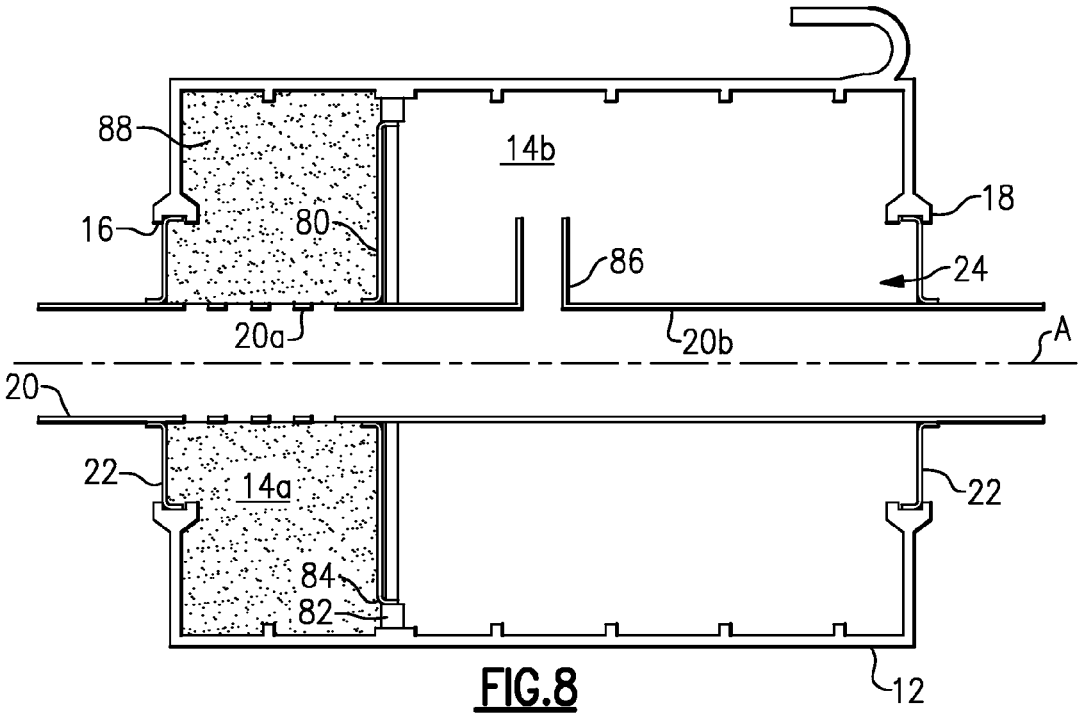
FIG. 8 is a schematic view of another example of a plastic muffler with a Helmholtz chamber.

FIG. 8 shows a configuration where a metal baffle plate 80 is used to separate the internal cavity into first 14*a* and second 14*b* chambers. The baffle plate 80 extends radially outwardly from the metal inner pipe 20 toward the outer shell 12. A thermal seal 82 is positioned between the inner wall 44 of the outer shell 12 and an outermost edge 84 of the baffle plate 80. The metal inner pipe 20 is the only pipe that extends from the inlet 16 to the outlet 18. The metal inner pipe 20 includes a perforated portion 20*a* that is located within the first chamber 14*a* and a non-perforated portion 20*b* that is located within the second chamber 14*b*. The first chamber 14*a* forms an expansion chamber and the second chamber 14*b* forms the Helmholtz chamber 24. A Helmholtz neck 86 extends radially outwardly from the metal inner pipe 20 toward the outer shell 12. Packing material 88 is optionally included within the expansion chamber; however, packing material could also be utilized in the Helmholtz chamber.

Figure 9:
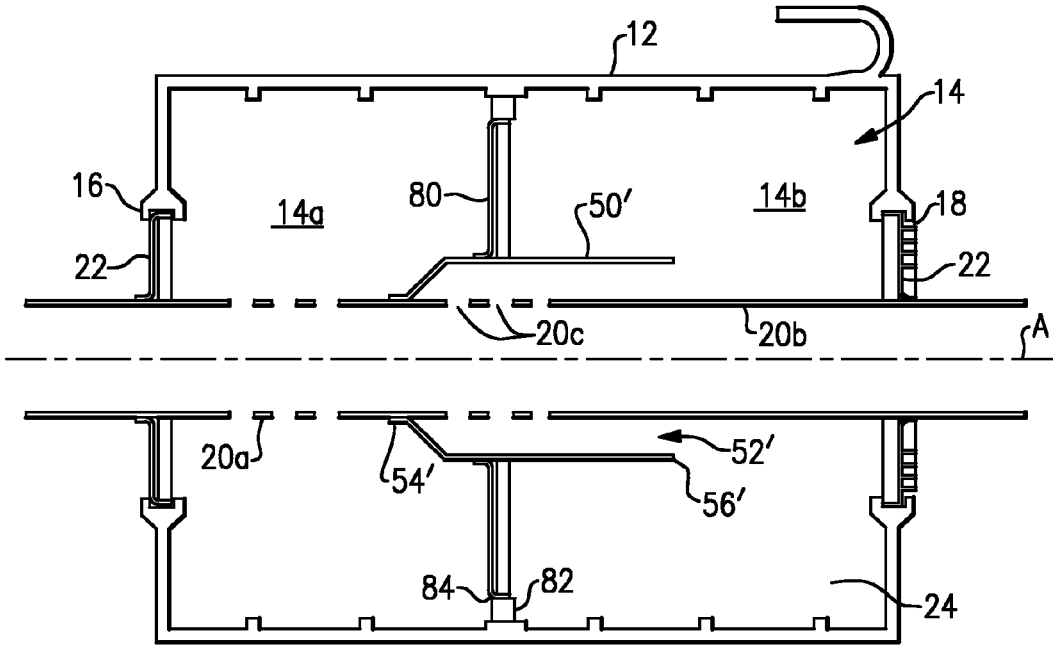
FIG. 9 is a schematic view of another example of a plastic muffler with a Helmholtz chamber.

FIG. 9 is similar to FIG. 8 but includes an overlap tube 50' similar to that shown in FIG. 2. The metal baffle plate 80 separates the internal cavity into first 14*a* and second 14*b* chambers. The metal inner pipe 20 extends from the inlet 16 to the outlet 18 and includes a first perforated portion 20*a* located within the first chamber 14*a* and a non-perforated portion 20*b* that is located in the second chamber 14*b*. In this example, one end 54' of the overlap tube 50' is secured to the metal inner pipe 20 in the first chamber 14*a* and an opposite end 56' of the overlap tube 50' is radially spaced from the metal inner tube 20 by a gap 52'. The opposite end 56' of the overlap tube 50' is located within the second chamber 14*b*, and thus forms a Helmholtz neck, making the second chamber 14*b* a Helmholtz chamber.

The overlap tube 50' is supported within the baffle 80 such that an outer surface of the overlap tube 50' is received within an opening in the baffle 80. The outermost edge 84 of the baffle 80 is supported within the outer shell 12 by the thermal seal 82. The metal inner pipe 20 includes at least two discrete openings 20*c* in the non-perforated portion 32*b*. These openings 20*c* in the inner pipe 20 are located inside of the overlap tube 50'.

Figure 10:
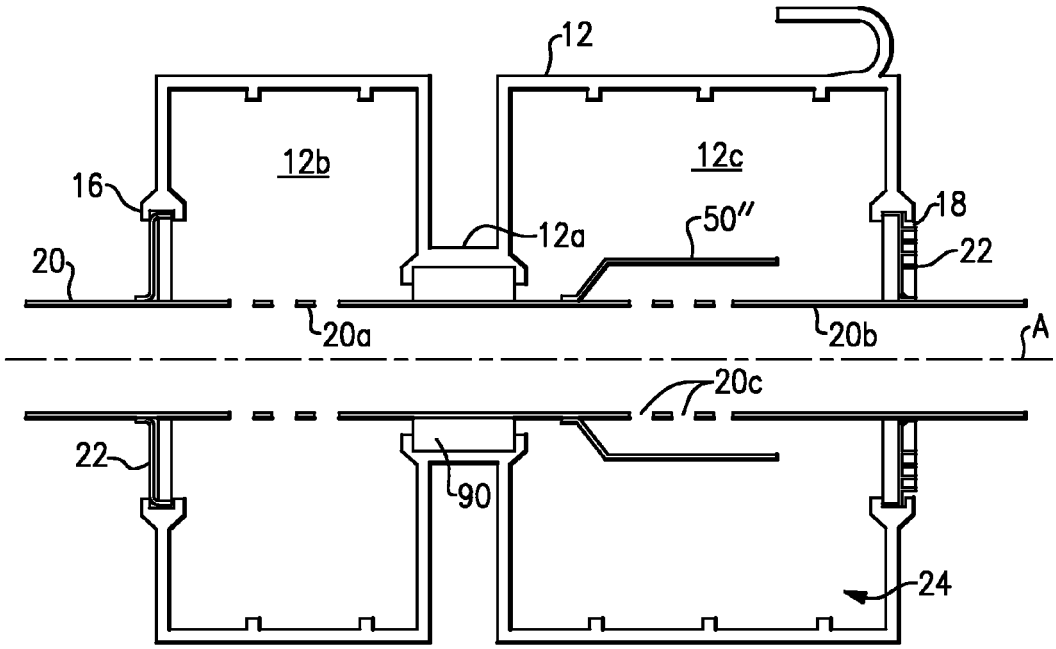
FIG. 10 is a schematic view of another example of a plastic muffler with a Helmholtz chamber.

FIG. 10 discloses an outer shell 12 with a reduced portion 12*a* that separates the outer shell 12 into first and second chambers 12*b* and 12*c*. The metal inner pipe 20 is the only pipe that extends from the inlet 16, through the reduced portion 12*a*, to the outlet 18. A thermal gasket or seal 90 supports the metal inner pipe 20 within the reduced portion 12*a*. The metal inner pipe 20 includes a perforated portion 20*a* located within the first chamber 12*b* and a non-perforated portion 20*b* that is located within the second chamber 12*c*.

An overlap tube 50" is mounted to the metal inner pipe 20 solely within the second chamber 12*c*. The overlap tube 50" is similar to that of FIG. 9 and forms the second chamber 12*c* as the Helmholtz chamber 24. The first chamber 12*b* comprises an expansion chamber.

Figure 11:
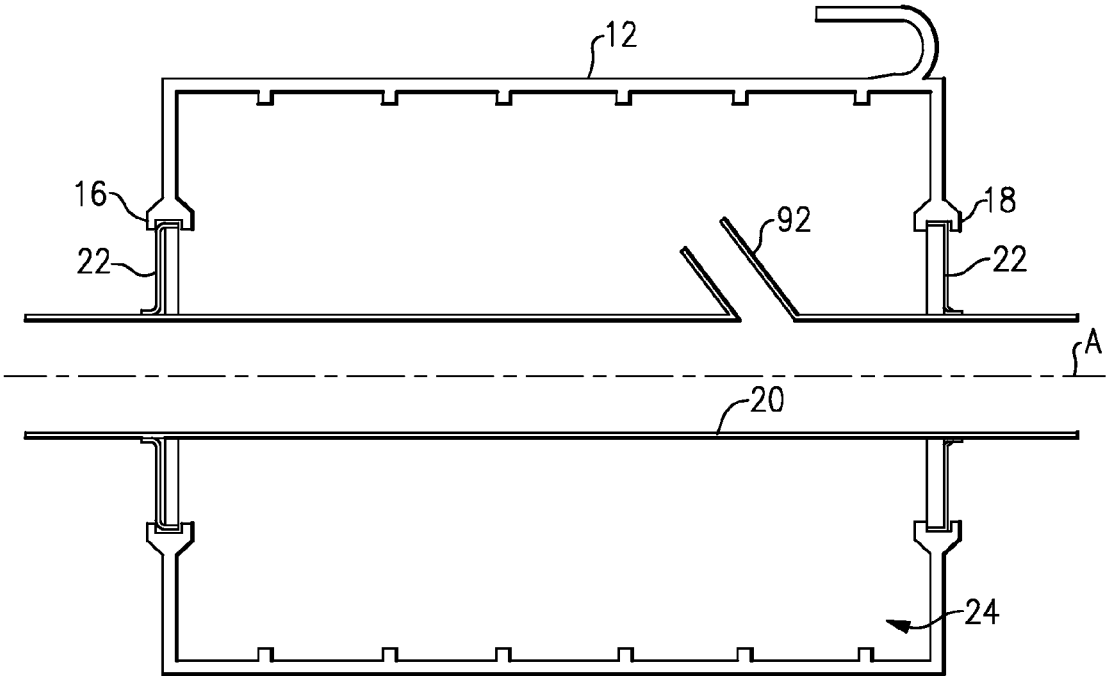
FIG. 11 is a schematic view of another example of a plastic muffler with a Helmholtz chamber.

FIG. 11 discloses a configuration where the metal inner pipe 20 includes a non-perforated portion that extends from the inlet 16 to the outlet 18. A Helmholtz neck 92 extends outwardly from the metal inner pipe 20 toward the plastic outer shell. In the example shown, the neck 92 extends rearwardly at an angle relative to the central axis A. This angle could be increased to be up to ninety degrees. In this configuration, the entire internal cavity 14 comprises the Helmholtz chamber 24.

Figure 12A:
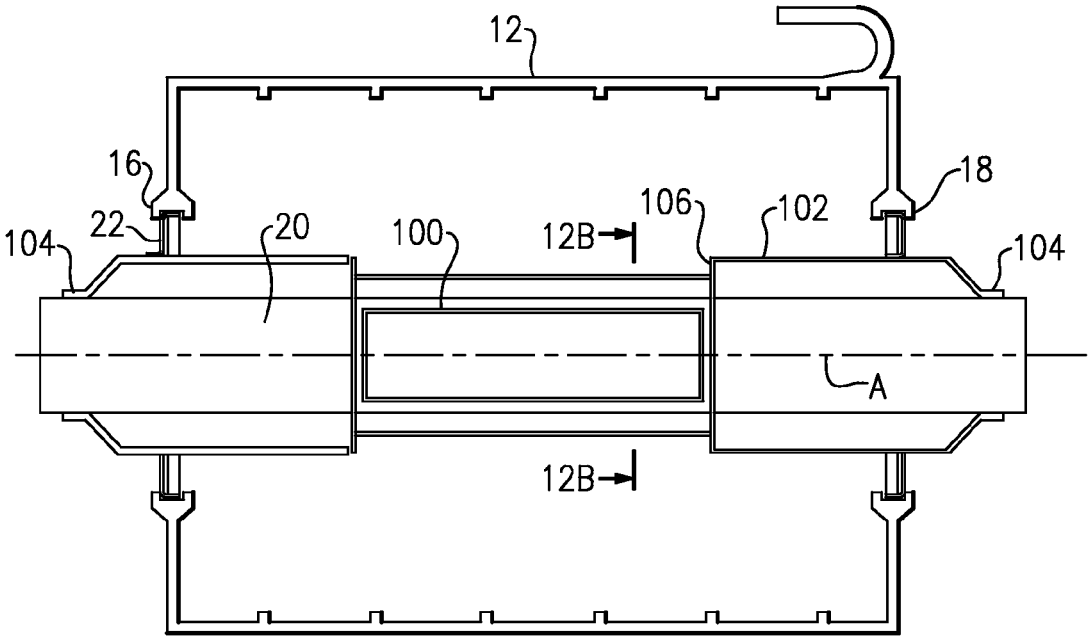
FIG. 12A is a schematic view of another example of a plastic muffler with a Helmholtz chamber.
Figure 12C:
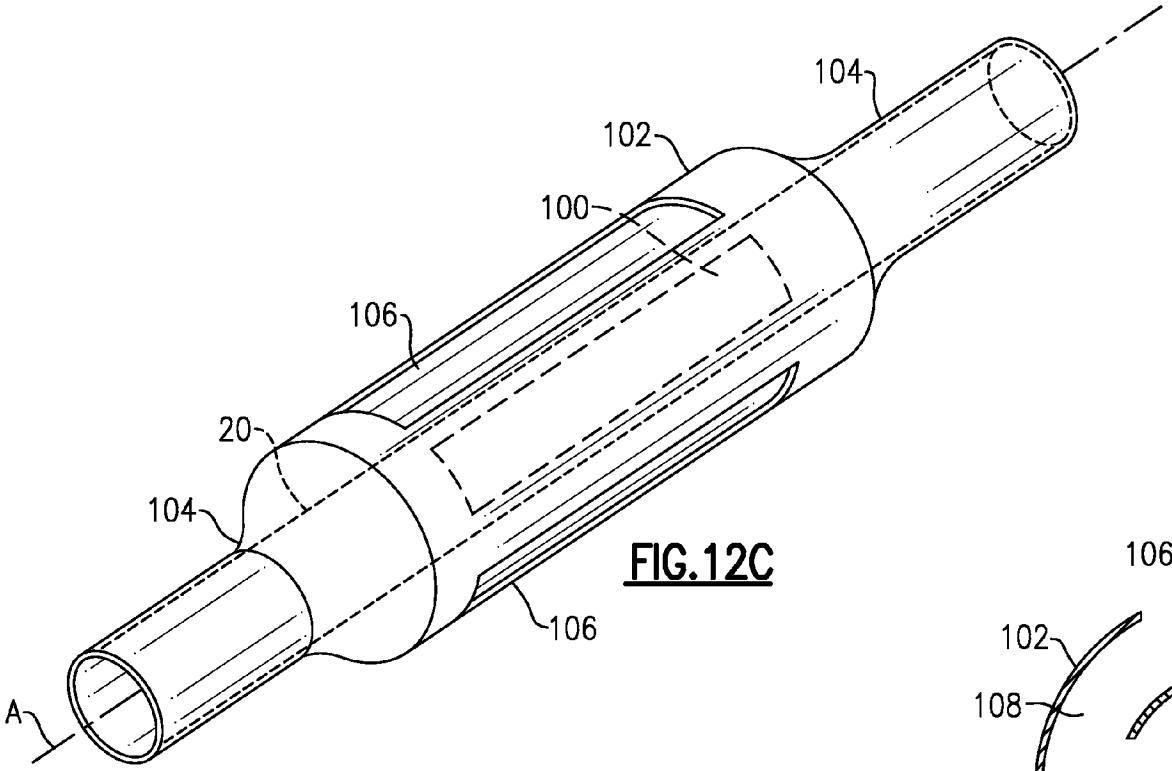
FIG. 12C is a perspective view of the inner and outer metal pipes from FIG. 12A.
Figure 12B:
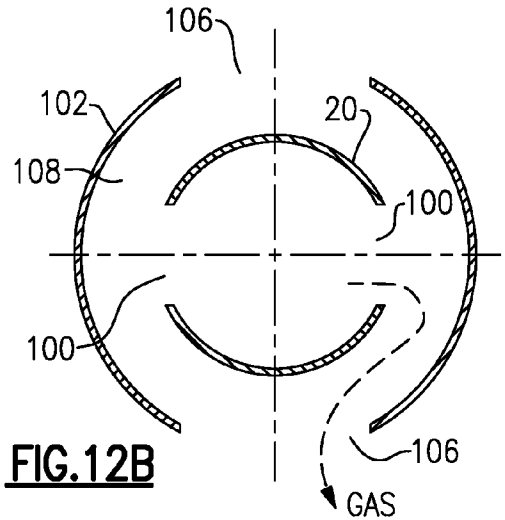
FIG. 12B is a cross-section taken of inner and outer metal pipes as shown at 12B-12B of FIG. 12A.

FIGS. 12A-12C show a configuration where the metal inner pipe 20 includes window cut-outs 100 at a location between the inlet 16 and the outlet 18. A metal outer pipe 102 surrounds the metal inner pipe 20 and includes ends 104 that are connected by sizing for example, at a location outside of the outer shell 12. The metal outer pipe 102 includes window cut-outs 106 that are orientated such that they are axially aligned with the cut-outs 100 of the metal inner pipe 20, but are not radially aligned with the cut-outs 100. In other words, the cut-outs 100 of the metal inner pipe 20 face a solid wall of the metal outer pipe 102 and the cut-outs 106 of the metal outer pipe 102 face a solid wall of the metal inner pipe 20 as shown in FIG. 12C.

The inner 20 and outer 102 pipes are separated by an air gap 108. Exhaust gas flows through the metal inner pipe 20 and out of the cut-outs 100 into the air gap 108. The exhaust gas then flows out of the cut-outs 106 into the internal cavity 14 which forms the Helmholtz chamber 24. The cut-outs 100, 106 and gap 108 cooperate to form the Helmholtz neck. The size and number of cut-outs in the inner and outer pipes can be varied as needed to attenuate a desired frequency.

Figure 13:
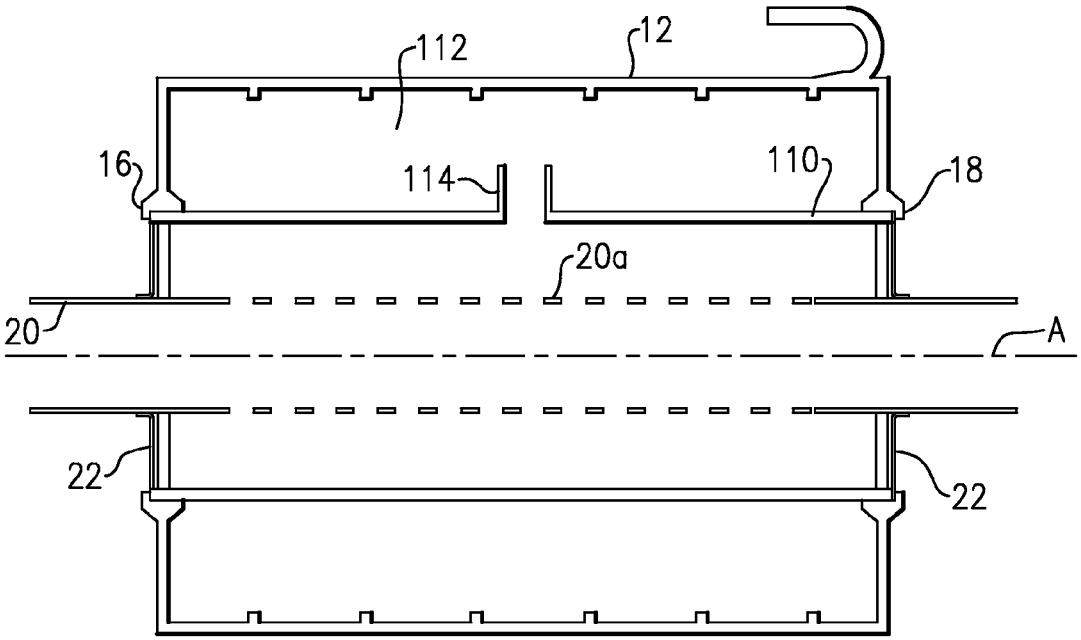
FIG. 13 is a schematic view of another example of a plastic muffler with a Helmholtz chamber.

FIG. 13 shows a configuration that includes a stamped muffler inner shell 110. The inner shell 110 is positioned within the internal cavity 14 and extends from the inlet 16 to the outlet 18. The inner shell 110 is spaced radially inwardly from the outer shell 12 to form a chamber 112. The metal inner pipe 20 is spaced radially inwardly of the inner shell 110 and extends through the center of the inner shell 110 from the inlet 16 to the outlet 18. The end plates 22 thermally seal off the radial area between the metal inner pipe 20 and the inner shell 110. A Helmholtz neck 114 is formed within the inner shell 110 that extends outwardly from the inner shell 110 toward the outer shell 12. The metal inner pipe 20 includes a perforated portion 20*a* along a substantial length of the pipe such that exhaust gas can flow out of the metal inner pipe 20 into the inner shell 110. The chamber 112 thus forms the Helmholtz chamber 24.

Figure 14:
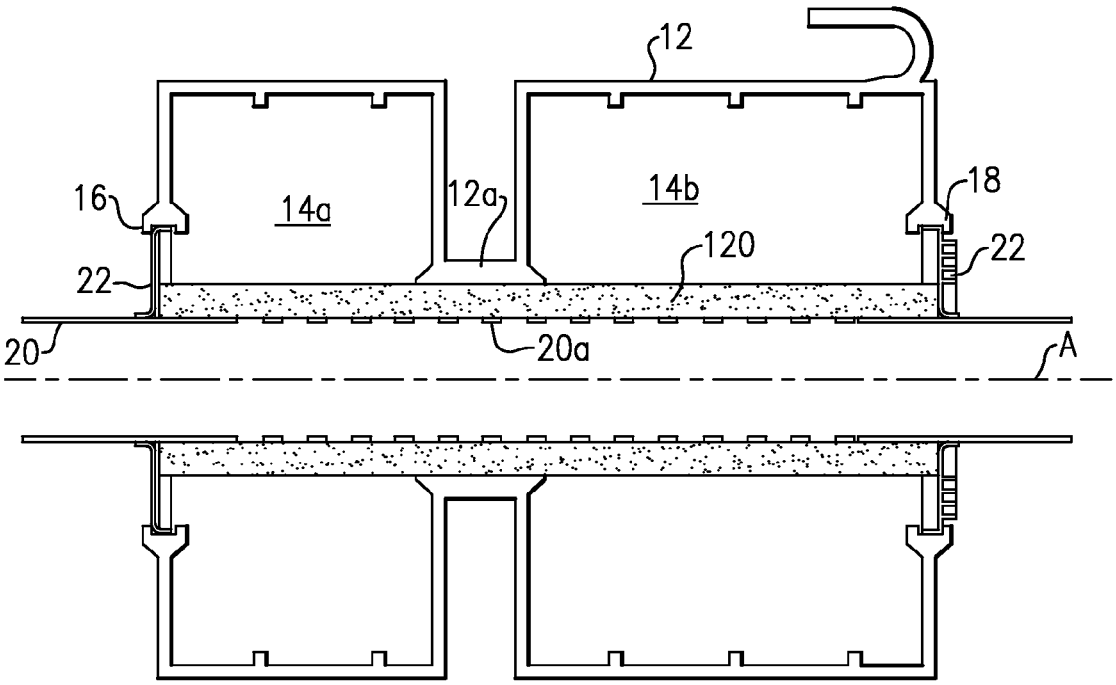
FIG. 14 is a schematic view of another example of a plastic muffler with a Helmholtz chamber.

FIG. 14 shows an outer shell 12 with a reduced portion 12*a* similar to that of FIG. 10, which separates the outer shell 12 into first 12*b* and second 12*c* chambers. However, instead of including an overlap tube, this configuration uses a layer of packing material 120 that is wrapped around the metal inner pipe 20. The metal inner pipe 20 extends from the inlet 16, through the first 12 chamber, through the reduced portion 12*a*, and through the second chamber 12*c* to the outlet 118. The metal inner pipe 20 includes a perforated portion 20*a* that is located in the first chamber 12*b*, the reduced portion 12*a*, and the second chamber 12*c*.

The layer of packing material 120 is wrapped around the length of metal inner pipe 20 that is located within the first chamber 12*b*, the reduced portion 12*a*, and the second chamber 12*c*. The first and second chambers 12*b*, 12*c* are substantially empty as the layer of packing material is localized along the inner pipe 20. The layer of packing material 120 fills any open area in the reduced portion 12*a*.

Figure 15:
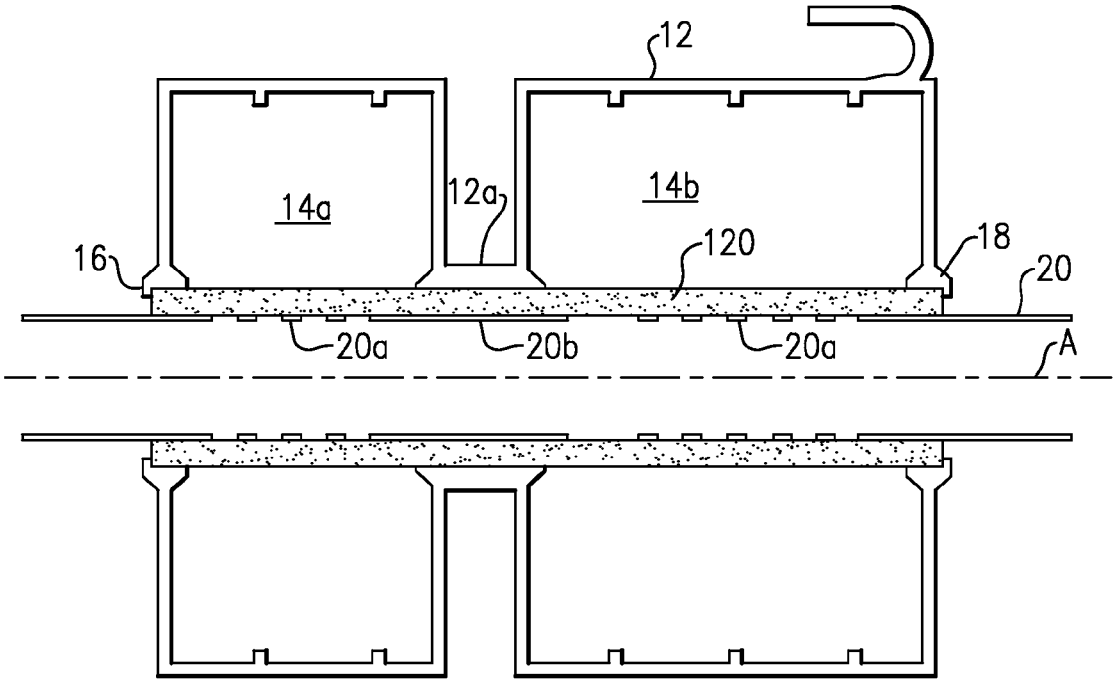
FIG. 15 is a schematic view of another example of a plastic muffler with a Helmholtz chamber.

FIG. 15 is similar to FIG. 14 except in the configuration of FIG. 15 the metal inner pipe 20 includes a non-perforated portion located within the reduced portion 12*a*. In either configuration, a Helmholtz neck could be added in one of the chambers.

The subject muffler comprises a hybrid muffler configuration where a plastic outer shell with an inner metal tube extending from an inlet to an outlet also includes a Helmholtz resonator in a reduced pack configuration. Reducing the amount of packing material reduces the weight of the plastic muffler as compared to a traditional packed configuration. Further, using a combination of reduced pack and the Helmholtz resonator provides a plastic muffler configuration that is capable of attenuating specific frequencies.

It should be understood that in any of the various embodiments shown above, packing material may be included within any chamber and/or removed from any chamber in any combination as needed to achieve a desired noise attenuation characteristic.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A muffler for a vehicle exhaust system comprising:

a plastic outer shell defining an internal cavity, said plastic outer shell including an inlet and an outlet;

a metal inner pipe positioned within said internal cavity and extending from said inlet to said outlet;

a Helmholtz chamber formed within said plastic outer shell;

a shielding cartridge comprising a metal outer pipe that surrounds at least a portion of an axial length of said metal inner pipe within said internal cavity; and a thermally insulating end plate decoupling said plastic outer shell from said metal outer pipe at each of said inlet and said outlet.

2. The muffler according to claim 1 wherein said internal cavity is not fully packed such that at least a portion of said internal cavity is free from packing material.

3. The muffler according to claim 1 including a Helmholtz neck associated with at least one of said metal inner pipe or said plastic outer shell.

4. The muffler according to claim 1 wherein said metal inner pipe includes at least one perforated section.

5. The muffler according to claim 1 including packing material positioned within a gap formed between said inner and said outer metal pipes.

6. The muffler according to claim 5 wherein said metal outer pipe surrounds an entire axial length of said metal inner pipe located within said internal cavity.

7. The muffler according to claim 5 including an overlap tube spaced radially from said metal outer pipe along a predefined length of said shielding cartridge to form an air gap between said overlap tube and said metal outer pipe, said overlap tube forming a Helmholtz neck.

8. The muffler according to claim 5 including a baffle that separates said internal cavity into first and second chambers, with one of said first and second chambers comprising said Helmholtz chamber and the other of said first and second chambers comprising an expansion chamber, and including a Helmholtz neck extending outwardly from said metal inner tube, said Helmholtz neck being located within said Helmholtz chamber and said shielding cartridge being substantially located within said expansion chamber.

9. The muffler according to claim 5 including a Helmholtz neck extending outwardly from said metal inner tube, said Helmholtz neck being axially spaced apart from said shielding cartridge within said internal cavity.

10. The muffler according to claim 5 including a Helmholtz neck extending radially toward said metal outer pipe and supported by said plastic outer shell via a baffle extending in a direction common to a direction defined by a central axis extending along a length of said metal inner pipe, said Helmholtz neck and baffle cooperating to separate said internal cavity into first and second chambers, with one of said first and second chambers comprising said Helmholtz chamber and the other of said first and second chambers comprising an expansion chamber.

11. The muffler according to claim 1 including a baffle that separates said internal cavity into first and second chambers, with one of said first and second chambers comprising said Helmholtz chamber and the other of said first and second chambers comprising an expansion chamber, and including a Helmholtz neck extending outwardly from said metal inner pipe, and wherein said metal inner pipe includes a perforated portion and a non-perforated portion, said Helmholtz neck and said non-perforated portion being located within said Helmholtz chamber and said perforated portion being located within said expansion chamber.

12. A muffler for a vehicle exhaust system comprising:

a plastic outer shell defining an internal cavity, said plastic outer shell including an inlet and an outlet;

a metal inner pipe positioned within said internal cavity and extending from said inlet to said outlet;

a Helmholtz chamber formed within said plastic outer shell;

a shielding cartridge comprising a metal outer pipe that surrounds at least a portion of an axial length of said metal inner pipe within said internal cavity, and including packing material positioned within a gap formed between said inner and said outer metal pipes; and a Helmholtz neck spaced radially from said metal outer pipe and supported by said plastic outer shell via a baffle extending in a direction transverse to a central axis extending along a length of said metal inner pipe, said Helmholtz neck and baffle cooperating to separate said internal cavity into first and second chambers, with one of said first and second chambers comprising said Helmholtz chamber and the other of said first and second chambers comprising an expansion chamber.

13. A muffler for a vehicle exhaust system comprising:

a plastic outer shell defining a central axis and providing an internal cavity, said plastic outer shell including an inlet and an outlet extending along said central axis, and wherein said internal cavity is not fully packed such that at least a portion of said internal cavity is free from packing material;

a metal inner pipe positioned within said internal cavity and extending along said central axis from said inlet to said outlet to direct exhaust gas through said plastic outer shell;

a Helmholtz chamber formed within said plastic outer shell;

a Helmholtz neck associated with at least one of said metal inner pipe or said plastic outer shell;

a thermally insulating end plate decoupling said plastic outer shell from said metal inner pipe at each of said inlet and said outlet; and a shielding cartridge comprising a metal outer pipe that surrounds at least a portion of an axial length of said metal inner pipe within said internal cavity, wherein said thermally insulating end plate extends between said metal outer pipe and said plastic outer shell at least at one of said inlet and said outlet, and including packing material positioned within a gap formed between said inner and said outer metal pipes.

14. The muffler according to claim 13 wherein said Helmholtz neck is spaced radially from said metal outer pipe and is supported by said plastic outer shell via a baffle extending in a direction transverse to the central axis extending along a length of said metal inner pipe.

15. The muffler according to claim 14 wherein said Helmholtz neck and said baffle cooperate to separate said internal cavity into first and second chambers, with one of said first and second chambers comprising said Helmholtz chamber and the other of said first and second chambers comprising an expansion chamber.

16. The muffler according to claim 13 wherein said metal outer pipe has at least one end that is connected to said metal inner pipe at a location outside of said plastic outer shell.

17. The muffler according to claim 1 wherein said metal outer pipe has at least one end that is connected to said metal inner pipe at a location outside of said plastic outer shell.

18. A muffler for a vehicle exhaust system comprising:

a plastic outer shell defining a central axis and providing an internal cavity, said plastic outer shell including an inlet and an outlet extending along said central axis;

a metal inner pipe positioned within said internal cavity and extending along said central axis from said inlet to said outlet;

end faces at each of the inlet and outlet, and including a thermally insulating end plate decoupling said plastic outer shell from said metal inner pipe at each of said inlet and said outlet, and wherein the end faces are formed in part by the plastic outer shell and in part by the thermally insulating end plates;

a shielding cartridge comprising a metal outer pipe that surrounds at least a portion of an axial length of said metal inner pipe within said internal cavity, and wherein said thermally insulating end plate extends between said metal outer pipe and said plastic outer shell at least at one of said inlet and said outlet; and a Helmholtz chamber formed within said plastic outer shell.

19. The muffler according to claim 18 including at least one of a Helmholtz neck or overlap tube spaced radially outward of said metal inner pipe.

20. The muffler according to claim 18 wherein said metal outer pipe has at least one end that is connected to said metal inner pipe at a location outside of said plastic outer shell.

* * * * *